United States Patent [19]

Collett

[11] Patent Number: 4,651,514

[45] Date of Patent: Mar. 24, 1987

[54] ELECTRICALLY NONCONDUCTIVE, ABRASION AND CUT RESISTANT YARN

[75] Inventor: C. William Collett, Harrisburg, Ill.

[73] Assignee: Nationwide Glove Co. Inc., Harrisburg, Ill.

[21] Appl. No.: 667,274

[22] Filed: Nov. 1, 1984

[51] Int. Cl.[4] ..... A41D 19/00; D02G 3/02; D02G 3/36

[52] U.S. Cl. ..... 57/227; 2/167; 57/902

[58] Field of Search ..... 57/210, 211, 226, 227, 57/228, 902; 2/48, 50, 51, 22, 23, 161 R, 167

[56] References Cited

U.S. PATENT DOCUMENTS

| | | | |
|---|---|---|---|
| 763,377 | 6/1904 | Drury | 57/224 |
| 2,044,130 | 6/1936 | Sowter | 57/210 |
| 2,317,910 | 4/1943 | Hill | 57/211 |
| 2,503,237 | 4/1950 | Palm et al. | 57/210 |
| 2,526,523 | 10/1950 | Weiss | 57/210 |
| 3,049,153 | 8/1962 | Jones | 139/426 R |
| 3,395,527 | 8/1968 | Longley | 57/238 |
| 3,828,544 | 8/1974 | Alker | 57/210 |
| 3,883,898 | 5/1975 | Byrnes, Sr. | 2/167 |
| 4,004,295 | 1/1977 | Byrnes, Sr. | 2/161 R |
| 4,100,727 | 7/1978 | Hamel | 57/12 |
| 4,202,382 | 5/1980 | Westhead | 57/210 X |
| 4,274,448 | 6/1981 | Westhead | 57/210 X |
| 4,381,639 | 5/1983 | Kress | 57/210 X |
| 4,384,449 | 5/1983 | Byrnes Sr. et al. | 57/210 |
| 4,470,251 | 9/1984 | Bettcher | 57/210 X |

*Primary Examiner*—Stuart S. Levy
*Assistant Examiner*—Joseph J. Hail, III
*Attorney, Agent, or Firm*—Wood, Dalton, Phillips, Mason & Rowe

[57] ABSTRACT

An electrically non-conductive, cut and abrasion resistant yarn for use in the manufacture of protective coverings including a core of monofilament nylon having a diameter in the range of about 0.004 to 0.020 inches, a first wrap on the core of at least one strand of aramid fiber having a cotton count size in the range of about 1/1 to 30/1 and a second wrap on the core of texturized nylon of two to eight ply construction. Each ply is made up of 24 to 44 nylon filaments with each filament being about 50–90 denier.

12 Claims, 4 Drawing Figures

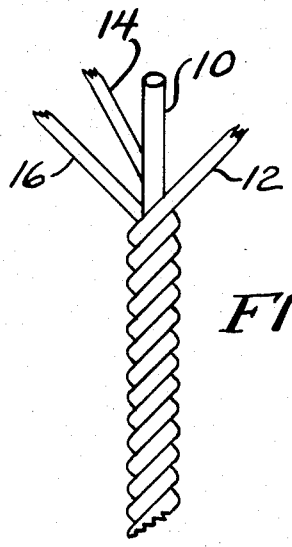
FIG. 1
FIG. 2
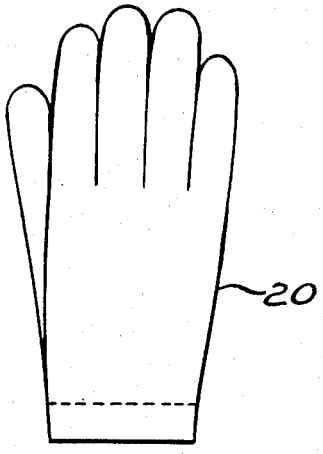
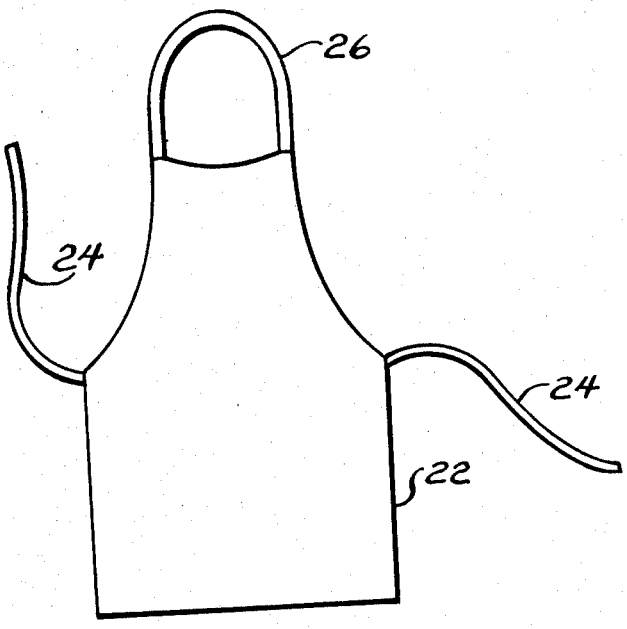
FIG. 3
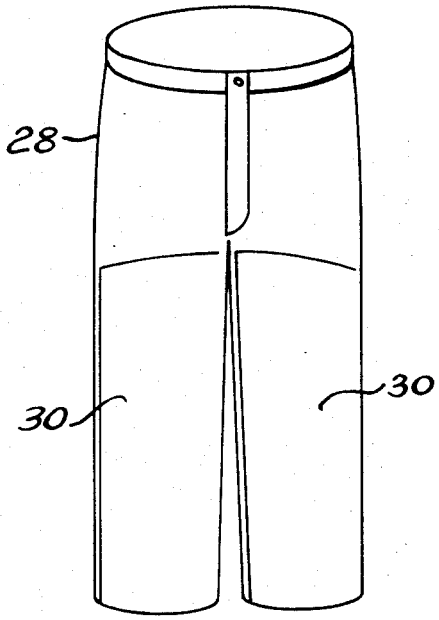
FIG. 4

ELECTRICALLY NONCONDUCTIVE, ABRASION AND CUT RESISTANT YARN

FIELD OF THE INVENTION

This invention relates to an abrasion and cut resistant yarn which is electrically non-conductive and which is suited for use in the manufacture of protective coverings such as apparel items.

BACKGROUND OF THE INVENTION

The need for flexible protective coverings has been historically present. Leather was perhaps one of the first materials used for the purpose and remains popular for many uses today. Garments have also been made of metal as, for example, so-called "chain mail". All too frequently, the weight and/or bulk and/or stiffness of some of the historically used materials has been unsuitable for many uses wherein protective covering, particularly as apparel items, has been required.

More recently, extremely tough synthetic materials have been developed and, in many instances, have replaced the materials that were historically employed in forming protective coverings. Aramid containing materials are a good example. Aramid is favored for many applications because of its flexibility, temperature resistance, chemical resistance and resistance to abrasion. However, aramid is not as cut resistant as may be desired for many applications.

Consequently, aramid has been paired with wire and the combination used in forming protective coverings. Aramid brings to the combination its previously mentioned desirable characteristics while the wire enhances the cut resistance of the article formed.

At the same time, the combination is not without its drawbacks. For one, if the wire is too thick, flexibility of the protective covering is impaired; and this is particularly undesirable where the protective covering is in the form of apparel such as a glove or an apron.

Where the size of the wire is reduced to promote flexibility, repeated flexure of the protective covering may result in the breaking of the wire. While this may not seriously impair the protective nature of the covering, when the covering is used as an item of apparel, particularly when used as glove, the broken ends of the wire may work their way free of the surface of the protective covering and pierce the skin of the wearer.

Furthermore, because of the use of wire necessarily entails the use of a metal, protective coverings formed from aramid and wire will be electrically conductive and therefore cannot be used as protection in an environment where electrical energy poses a potential hazard.

The present invention is directed to overcoming one or more of the above problems and additionally, is directed to providing a yarn-like material having improved abrasion and cut-resistance over aramid and wire combinations.

SUMMARY OF THE INVENTION

It is the principal object of the invention to provide a new and improved yarn for use in the manufacture of protective coverings. More specifically, it is an object of the invention to provide such a yarn, including aramid material, with enhanced cut and abrasion resistance and one which is electrically non-conductive so that it may be used in the manufacture of protective coverings which in turn may be employed in a large number of differing environments wherein protective coverings required.

An exemplary embodiment of the invention achieves the foregoing objects in a cored yarn wherein the core is formed of monofilament nylon having a diameter in the range of about 0.004 to 0.020 inches. The core is wrapped with at least one strand of aramid fiber of cotton count size in the range of about 1/1 to 30/1.

In a preferred embodiment, the wrap on the core comprises two strands of aramid fiber and may additionally include bulk providing fibrous materials such as stretched or texturized nylon.

In a highly preferred embodiment, the monofilament nylon core has a diameter of about 0.010 inches. The aramid wrap has a preferred cotton count size of 8/1. The nylon wrap is preferably a multi-ply wrap of nylon fibers. Two to eight plies may be used, each having about 24–44 nylon filaments. Each filament is of about 50–90 denier.

In a highly preferred embodiment, the nylon wrap is made up of eight plies of approximately 34 nylon filaments each, each filament being about 70 denier.

In the yarn, the core comprises 10–30% by weight while the aramid wrap comprises 41–61% by weight. The nylon wrap comprises 19–39% by weight.

In a highly preferred embodiment, the weight of the core is about 20%, the aramid about 51% and the nylon wrap about 29%, all in weight percents.

Other objects and advantages will become apparent from the following specification taken in connection with the accompanying drawings.

DESCRIPTION OF THE DRAWINGS

FIG. 1 is a somewhat schematic, perspective view of a yarn made according to the invention;

FIG. 2 is a perspective view of one form of protective covering that may be made utilizing the yarn, and in particular, an item of apparel, namely a glove;

FIG. 3 is a perspective view of another form of protective covering, namely an apron; and FIG. 4 illustrates still another article in which the yarn may be used, specifically a pair of pants having chap-like fronts on the legs, which fronts are made of fabric utilizing the yarn.

DESCRIPTION OF THE PREFERRED EMBODIMENTS

An exemplary embodiment of a yarn made according to the invention and specific articles in which it may be used are illustrated in the drawing. However, it is to be understood that the yarn is not limited to use in the articles specifically illustrated, which are all items of apparel, but may find use in protective coverings of non-apparel as, for example, protective blankets or the like.

With reference to FIG. 1, a yarn made according to the invention is seen to be a cored yarn having a core 10 formed of a single strand of monofilament nylon. Preferably, the core 10 has a diameter in the range from about 0.004 to 0.020 inches. In a highly preferred embodiment, the diameter of the core 10 is 0.010 inches.

The selection of the diameter will depend, in a large measure, on strength and flexibility requirements. The smaller the diameter, the lesser the strength and vice versa. Similarly, the greater the diameter, the lesser the flexibility and vice versa. Generally speaking, high strength with maximum flexibility will be preferred and this combination of characteristics is provided by the preferred diameter set forth above. In most cases, flexibility requirements will be determined by (a) the desired flexibility of the protective covering to be formed of the yarn and (b) the ability of processing machinery to knit, weave or otherwise fabricate the protective covering.

The core 10 is provided with a twisted wrap of three strands 12, 14 and 16 in alternating fashion. The strand 12 is of fibrous material which provides a source of bulk to the overall yarn. Preferably, so-called stretch or texturized nylon is utilized for the purpose. The strand 12 preferably will be formed of a multiple ply nylon having two-eight plies. Each ply will be made up of twenty-four to forty-four nylon filaments, and each filament will have a size in the range of about 50–90 denier. In a preferred embodiment, the strand 12 is eight ply, thirty-four filament, 70 denier nylon.

The strands 14 and 16 are made of aramid yarn. They may be the same in make-up or dissimilar. Preferably, for economy, they are identical and each has a cotton count size in the range of about 1/1 or equivalent to about 30/1 or equivalent. In a preferred embodiment, a cotton count size of 8/1 or equivalent is employed.

The yarn is made up on conventional equipment employed in making cored yarns such that the core accounts for about 10–30% by weight of the finished yarn. The stretch or texturized nylon strand 12 preferably accounts for about 19–39% by weight while the aramid strands 14 and 16 account for approximately 41–61% by weight. In a highly preferred embodiment, the core constitutes 20% by weight; and texturized or stretch nylon 12 accounts for 29% by weight and the aramid strands 14 and 16 account for 51% by weight.

FIG. 2 illustrates one product which may be manufactured utilizing a yarn made according to the invention. The same is in the form of a protective glove 20 which may be knitted on conventional glove manufacturing machinery. The glove 20 may be utilized in a variety of environments. Because the same will have superior cut and abrasion resistance, it may be used with greatest efficacy in the meatpacking industry. However, because the yarn of which the glove 20 is made has no metal or other electrically conductive material, it may be used for protection in any environment where protection is required, even those where the presence of electrical power poses a hazard.

Another protective covering that may be formed by knitting, weaving, etc. out of the yarn of the invention is illustrated in FIG. 3 in the form of an apron having an apron front 22, tie strings 24 and a head receiving loop 26. The apron front 22 may be made of a knitted or woven material formed of the yarn.

Still another protective covering which may be formed utilizing the yarn is shown in FIG. 4. Specifically there is shown a pair of hunting pants or the like. The pants may include a conventional cloth body 28 and on the fronts of the legs there may be superimposed a fabric made using the yarn to provide chaps 30.

Of course, the yarn is not limited to use in the manufacture of articles such as shown in FIGS. 2–4 inclusive. Other items of protective apparel may also be formed of the yarn as, for example, protective sleeves. Moreover, protective covers of a nonapparel type, particularly where abrasion and wear resistant along with electrical non-conductivity are required may be made using the yarn. Various sorts of protective blankets or sleeves constitute examples.

A yarn made according to the invention has substantial advantages over those heretofore utilized. For one, those employing wire cores may cause some difficulty when employed in apparel type protective coverings. As mentioned previously, the wire, after repeated flexure, may break and the end of the wire, at the break, may penetrate the skin of a wearer of the protective covering due to the fact that fractures of metallic structures, such as wire, tend to be quite sharp. In contrast, the nylon core of the present invention is much less likely to break over repeated flexure and even should it fracture it is extremely unlikely to fracture in an end sharp enough to penetrate the skin of the wearer of a protective covering made of the yarn.

The same characteristic of the invention provides a further advantage over prior art structures such as referred to immediately preceding. In particular, such prior art structures typically employ a two strand core, one of wire and the other of a synthetic material. The strand of synthetic material is required to prevent the yarn from separating at the break point of the wire core when repeated flexures cause such breakage. Through the use of a yarn made according to the present invention, a single core strand can be employed.

In some instances, the bulk providing strand, namely the strand 12, may be eliminated. Generally, however, it will be incorporated since it adds strength and weight to the yarn and in the preferred embodiment, acts as a binder. It desirably adds bulk to the yarn and in many instances, due to its relatively friction-free surface, provides for easier processing.

Still a further advantage of a yarn made according to the present invention resides in the fact that the materials employed in making it up are less expensive than those in the prior art construction since the relatively high cost wire component of such structures is eliminated, as may be one of the core strands.

It has been determined, in comparative testing, between gloves, such as the glove 20 shown in FIG. 2, made according to the invention and according to the prior art utilizing wire cored yarn that a glove made with a yarn as disclosed herein has an almost six times greater abrasion resistance than the prior art glove. Similarly, in a cut resistance test a glove knit of yarn made according to the invention exhibited a 43% improvement in cut resistance over the prior art glove.

Thus, not only does yarn of the invention allow the manufacture of protective coverings that may be utilized in environments wherein electrical power may be a hazard due to the non-conductivity of the yarn, and minimize the possibility of puncture wounds from broken core strands, it provides vastly superior abrasion and cut resistance. This yarn, or products made therefrom, may also be coated for special characteristics as liquid impermeability with known materials suitable for the purpose. Vinyl, latex, rubber or the like are examples of typical coating materials.

I claim:

1. A yarn for use in the manufacture of protective covering comprising:

a core of monofilament nylon having a diameter in the range of about 0.004 to 0.020 inches;

a first wrap on said core comprising at least one strand of aramid fiber equivalent to cotton count size in the range of about 1/1 to 30/1; and a second wrap on said core comprising a strand having about 2 to 8 plies each of 24 to 44 nylon filaments, each filament being about 50 to 90 denier.

2. The yarn of claim 1 wherein said monofilament core has a diameter of about 0.010 inches.

3. The yarn of claim 1 wherein there are two said strands of aramid fiber in said first wrap.

4. The yarn of claim 3 wherein each strand of aramid fiber has a cotton count size equivalent to about 8/1.

5. The yarn of claim 1 wherein the strand of said second wrap is of 8 ply, 70 denier, 34 filament stretch nylon.

6. The yarn of claim 1 wherein said core comprises 10–30%, said first wrap comprises 41–61% and said second wrap comprises 19–39% by weight of said yarn.

7. The yarn of claim 1 wherein said core is about 20%, said first wrap is about 51% and said second wrap is about 29% by weight of said yarn.

8. An electrically non-conductive, abrasion and cut resistant yarn for use in protective coverings comprising:

a core of monofilament nylon having a diameter of at least about 0.010 inches;

a first wrap on said core comprising two strands of aramid fiber equivalent to cotton count size in the range of about 1/1 to 30/1; and a second wrap on said core of stretch nylon having about 2 to 8 plies each of 24 to 44 nylon filaments, each filament being about 50–90 denier.

9. The yarn of claim 8 wherein said cotton count size of at least one of said aramid strands is about 8/1.

10. The yarn of claim 8 wherein said stretch nylon has about 8 plies.

11. The yarn of claim 8 wherein said cotton count size is equivalent to about 8/1 and said stretch nylon has about 8 plies.

12. A cored yarn for use in the manufacturing of protective coverings comprising:

a core of monofilament nylon having a diameter of about 0.010 inches; and a wrap on said core comprising two strands of aramid fiber equivalent to cotton count size 8/1 and a fibrous bulk providing yarn of multiple ply, nylon filament yarn.

* * * * *